US006564417B2

(12) United States Patent
Porat

(10) Patent No.: US 6,564,417 B2
(45) Date of Patent: May 20, 2003

(54) CYLINDRICAL BRUSH WITH LOCKING PIN

(75) Inventor: Joseph Porat, North Caldwell, NJ (US)

(73) Assignee: Aqua Products, Inc., Cedar Grove, NJ (US)

( * ) Notice: Subject to any disclaimer, the term of this patent is extended or adjusted under 35 U.S.C. 154(b) by 0 days.

(21) Appl. No.: 09/754,975

(22) Filed: Jan. 4, 2001

(65) Prior Publication Data

US 2002/0083541 A1 Jul. 4, 2002

(51) Int. Cl.[7] ..... E04H 4/16; A46B 7/10

(52) U.S. Cl. ..... 15/179; 15/1.7; 15/141.2; 15/187

(58) Field of Search ..... 15/1.7, 141.2, 15/176.1, 176.6, 187, 202, 179, 181, 230, 230.14, 230.19

(56) References Cited

U.S. PATENT DOCUMENTS

| | | | | |
|---|---|---|---|---|
| 3,188,674 A | | 6/1965 | Hobbs | 15/179 |
| 3,245,518 A | | 4/1966 | Reibel et al. | 198/801 |
| 3,584,328 A | * | 6/1971 | Lechene et al. | 15/179 |
| 3,643,282 A | * | 2/1972 | Lechene et al. | 15/179 |
| 3,744,095 A | | 7/1973 | Tomlinson | 24/38 |
| 3,755,847 A | * | 9/1973 | Liebscher | 15/179 |
| 5,016,311 A | | 5/1991 | Young et al. | 15/88.3 |

FOREIGN PATENT DOCUMENTS

| | | | | |
|---|---|---|---|---|
| EP | 193695 | * | 9/1986 | 15/179 |
| FR | 1085091 | * | 1/1955 | 15/176.1 |

* cited by examiner

*Primary Examiner*—Mark Spisich
(74) *Attorney, Agent, or Firm*—Abelman, Frayne & Schwab

(57) ABSTRACT

A cleaning brush for a power-driven pool cleaner having a rotatable shaft incorporates a flexible web having first and second opposing edges, the first edge having at least one first element extending in the direction of the first edge, and the second edge having at least one second element extending in the direction of the second edge. The web is deformable about the rotatable shaft to bring the first and second edges into contact, with the first element being in spaced relation to the second element such that the first element is aligned with the second element. Additionally, a positive locking structure is provided to hold the first and second elements together in a secure, locking fit. Preferably, there are a plurality of elements on the first and second edges, with each element having an opening therethrough in the direction of or parallel to the respective edge, so that when the edges are in contact the openings are aligned to form a continuous open path, and the locking structure is a locking pin that is passed through the open path.

19 Claims, 2 Drawing Sheets

CYLINDRICAL BRUSH WITH LOCKING PIN

BACKGROUND OF THE INVENTION

1. Field of the Invention

This invention relates to replaceable rotating brushes for mounting on power-driven pool cleaners.

2. Description of Related Art

Automated or robotic power-driven pool cleaners typically include rotating brushes mounted on tubes or shafts extending across the body at the front and rear of the machine. The shaft on which the cleaning brush is mounted is rotatable and can be driven by one or more endless belts that engage grooved pulleys at either or both ends of the rotatable shaft.

The cleaning brushes can be made of a foamed polymer or plastic sponge material, in which case they are subject to wear and tear due to their continuous rotating contact with the bottom and side wall surfaces of the pool. As a result, foamed polymer cleaning brushes must be periodically removed and replaced. Various types of brushes have been used with pool cleaning machines of the prior art. Brushes in the form of elongated cylinders produced from molded polyvinyl acetate (PVA) having a relatively fine pore size are designed to cover the entire length of the rotatable shaft in a single piece. The molded PVA is relatively rigid when dry, but becomes softer and more pliable when wet with water which facilitates fitting it to the shaft.

Other types of brushes are formed as generally rectangular elements having a flat surface on the back which can be wrapped around and tightly fitted to the rotatable shaft. Interlocking tabs and openings at the mating ends of the flexible mat permit its secure assembly to the shaft in a generally cylindrical configuration. For example, the rotatable shaft often has indents or openings into which corresponding tabs of the mat are inserted. Elements of various configurations projecting from the exterior surface of the mat contact the pool surface with a scrubbing action to loosen debris and allow it to be drawn into the pool cleaner's filter system. The flat brushes can be produced as an integrally molded element using a synthetic rubber or polymer compound. The flat brushes can also be fabricated by drawing elongated rectangular pieces of cellular foamed plastic through openings in an open-weave backing material.

While each type of cleaning brush possesses certain advantages, and is intended for use under specific conditions, these prior art brushes face a drawback in the effort associated with removing a worn brush and installing a replacement cleaning brush. In the case of the cylindrical PVA foam brush, the old element can most easily be removed by cutting it away from the shaft. However, considerable effort is required to pull and properly fit the replacement brush on the shaft.

The dismounting of the prior art flat molded brushes is likewise facilitated by cutting the neck portion of the tabs where the mating ends overlap. Installing the new brush requires some strength since the interlocking elements have limited resiliency, which characteristic is required to enhance their ability to resist disengagement once assembled in the correct interlocking position. Therefore, after the tabs and slots of the overlying ends are brought into mating alignment, it can be difficult, especially for residential pool owners, to install the new brushes. Moreover, unless the interlocking elements of these brushes are fully positioned in their precise interlocking configuration, the possibility of disengagement is appreciable, in which case the brush can become loose or detached from the rotating shaft, so that it does not rotate properly and no cleaning of the pool surface is effected.

It is also known, in the case of the molded brushes having a flat backing surface, that mildew and dirt can be formed during periods of non-use and storage between the mounting shaft and the back, causing the elements to stick together and necessitating removal of the dirt, mold and mildew before a new brush can be installed.

In view of the above limitations and difficulties associated with the cleaning brushes of the prior art, it would be desirable to provide a cleaning brush for pool cleaners as original equipment or as a replacement for worn or damaged cleaning brushes that is easy to install securely and to remove.

It is therefore an object of the invention to provide a cleaning brush that can be easily and securely mounted during installation.

It is another object of the invention to provide a positively and securely mounted cleaning brush that can also be easily removed at such time as replacement is required.

It is a further object of the invention to provide a cleaning brush that has a minimum surface area in contact with the mounting shaft and that permits free circulation of water and air to facilitate drying.

The above objects, as well as additional advantages, will be realized in the practice of the invention as herein described. In its broadest embodiment, the improved cleaning brush comprises a flexible web having first and second opposing edges, the first edge having at least one first element extending in the direction of the first edge, and the second edge having at least one second element extending in the direction of the second edge. The web is deformable about the rotatable shaft to bring the first and second edges into contact, with the first element being in spaced relation to the second element such that the first element is aligned with the second element. Additionally, a positive locking structure is provided to hold the first and second elements together in a secure, locking fit.

SUMMARY OF THE INVENTION

In an especially preferred embodiment, there are a plurality of elements on the first and second edges, with each element having an opening therethrough in the direction of the respective edge, so that when the edges are in contact the openings are aligned to form a continuous open path, and the locking structure is in the form of a locking pin that passes through the open path.

BRIEF DESCRIPTION OF THE DRAWINGS

The invention will be further described with reference to the drawings in which like elements are represented by the same number, and where.

DETAILED DESCRIPTION OF THE PREFERRED EMBODIMENTS

Figure 1:
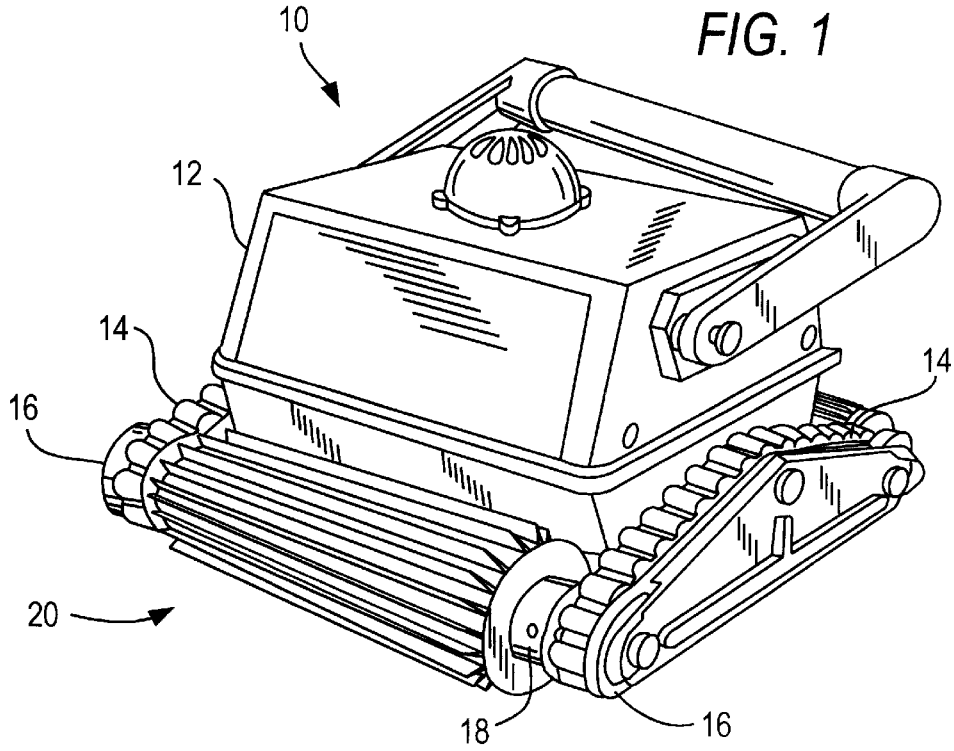
FIG. 1 is a perspective view of a pool cleaner fitted with the improved brush of the invention.

With reference to FIG. 1, the pool cleaner 10 comprises a housing or cover 12 and a pair of side-mounted drive belts 14 that engage pulleys 16 at opposite ends of the cleaner 10. Pulleys 16 are mounted and secured to the ends of transverse axles or shafts 18 which extend across the width of the pool cleaner 10. As shown in FIG. 1, each cleaning brush assembly 20 is mounted on one of the rotatable shafts 18 so that the cleaning brush assemblies 20 at each end support the pool cleaner 10 as it traverses the bottom and side walls of the pool during cleaning.

Figure 2:
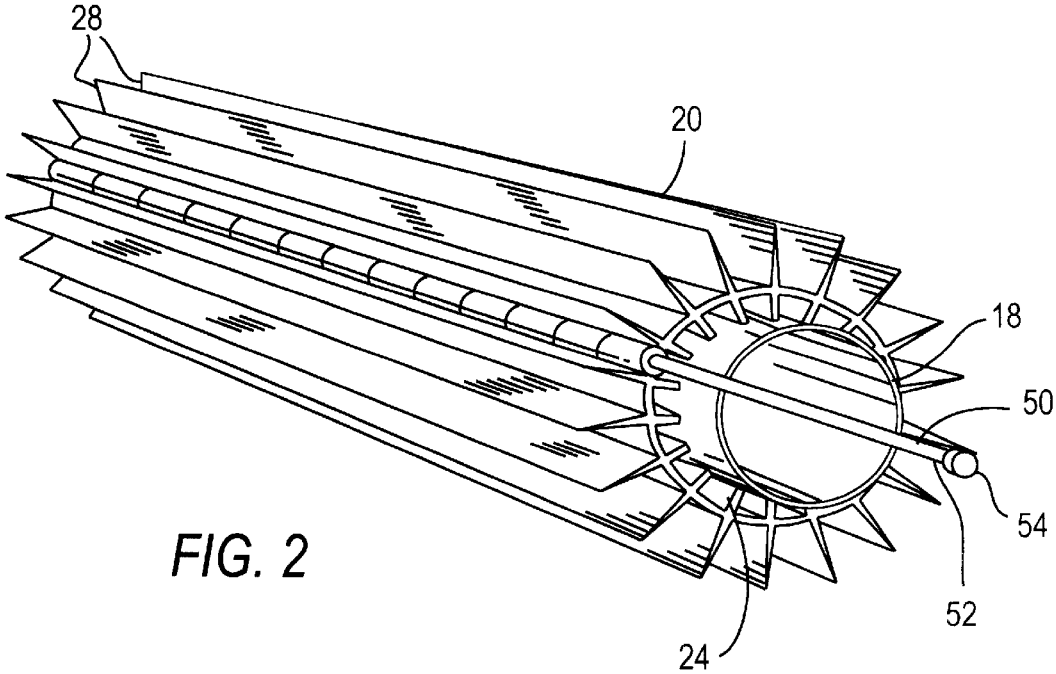
FIG. 2 is a perspective view of one embodiment of the brush of the invention as mounted on one of the rotatable shafts of the pool cleaner of FIG. 1.
Figure 3:
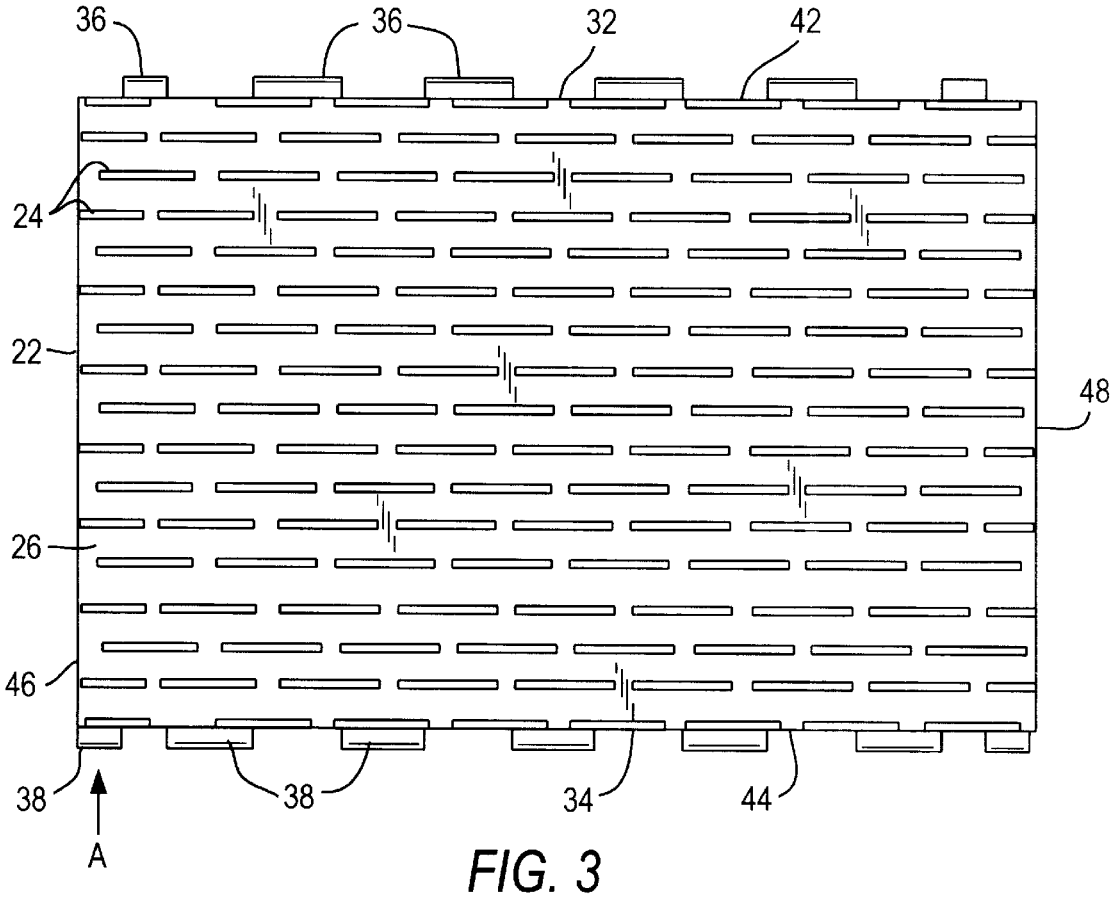
FIG. 3 is a top view of the brush of FIG. 2 prior to installation.

The cleaning brush assembly 20, as shown in FIG. 2, is, in a preferred embodiment, a molded plastic web that is initially flat, but pliable along its longitudinal axis so that it can thereafter be formed into a cylinder around shaft 18. As shown in FIG. 3, the web is molded as a generally planar web 22 from which project a plurality of internally projecting mounting ribs 24 that are normal to a first surface 26 of the web 22 and arranged in generally parallel rows. The spacing between the rows of ribs 24 permits water and air to circulate between mounting shaft 18 and surface 30 of web 22, thereby preventing the build-up of dirt, mold and mildew. This is due to the minimum surface area of ribs 24 that are in contact with the surface of the shaft 18.

In addition, a plurality of cleaning ribs 28 project from the opposite surface 30 of the web 22. In the embodiment of FIG. 3, the cleaning ribs 28, which are intended to contact and clean the surfaces of the pool during use of the pool cleaner 10, are normal to the surface 30 and are spaced apart in rows extending the width of the web 22. Advantageously, the cleaning ribs 28 are appropriately configured to ensure good cleaning contact with the surfaces of the pool and have the ability, as for example by being tapered, to deform slightly while encountering minor variations in the contour of the surface being cleaned. As will be apparent to one of ordinary skill in the art, the size, shape, configuration and orientation of the cleaning ribs and the spatial relation of the rows can be varied, as can the materials of construction of the brush assembly 20.

At opposing edges 32, 34 of the web that are parallel to the rows of mounting ribs 24 are, respectively, pluralities of first annular elements 36 and second annular elements 38. All of the annular elements 36, 38 are preferably molded integrally with the web 22. Each of the annular elements 36, 38 is formed with a central opening 40, all openings 40 having the same diameter. Alternatively, the annular elements can be formed separately, or in a separate element, and secured by mechanical means, by heat, or by adhesive bonding to the web 22.

Figure 4:
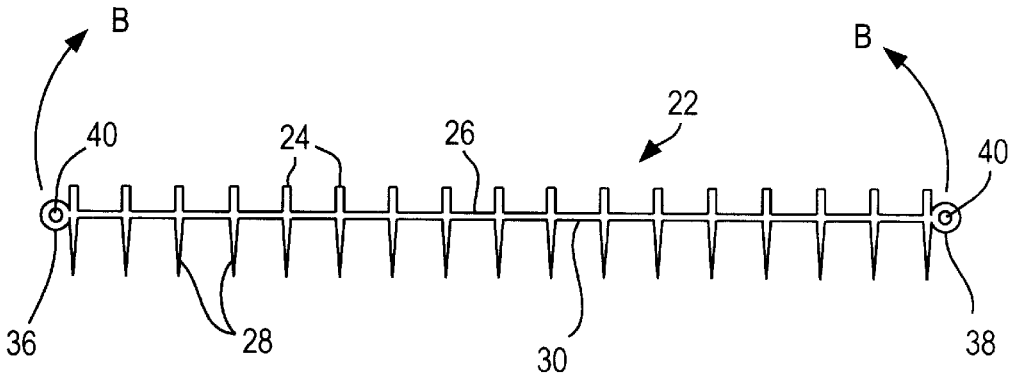
FIG. 4 is a side view of the brush of FIG. 3 taken along arrow A in FIG. 3.

As shown in FIG. 3, the first annular elements 36 are spaced along the edge 32 in a staggered relationship to the second annular elements 38 spaced along the edge 34 so that when the edge 32 is brought into contact with the edge 34, the first annular elements 36 fit within the spaces 44 between the second annular elements 38 and the second annular elements 38 fit within the spaces 42 between the first annular elements 36, much in the manner of hinge plates. Thus, in FIG. 4, if a shaft 18 were placed above the center of the web 22 in contact with the mounting ribs 24 and the edges 32, 34 brought into contact with each other by wrapping the web 22 around the shaft 18 in the direction of arrows B, the first annular elements 36 would fit between the second annular elements 38 with all the openings 40 in alignment to form a continuous open path from one side 46 of the web 22 to the other side 48.

As shown in FIG. 2, when the web 22 is so mounted onto the shaft 18, the mounting ribs 24 contact the shaft 18 and provide a secure, slip-free mounting structure.

Furthermore, in a preferred embodiment to be further described, when the web 22 is so mounted onto the shaft 18, the first annular elements 36 fit snugly into the spaces 44 between the second annular elements 38, and the second annular elements fit snugly into the spaces 42 between the first annular elements 36, so as to hold the two edges 32, 34 in contact, at least temporarily, without the use of human assistance. In addition to the tight fit, detents or other means may be used to facilitate and provide this initial frictional holding force or interference fit. In the prior art, the securement of the opposing edges of the mats depended on such frictional means, whether between portions of the mat or between the mat and the shaft. However, as shown in FIG. 2, in accordance with the present invention, a positive lock securement is provided by the use of a locking pin 50 that is threaded through the open path created by the alignment of the openings 40 of the first and second annular elements 36, 38. The locking pin 50 has a shaft 52 sized to pass easily, but securely through the openings 40, and a head 54 for easy handling by the person inserting or withdrawing the locking pin 50. The locking pin 50 is preferably fabricated from a chemically resistant and durable material, such as stainless steel or a rigid, but resilient engineering plastic, such as nylon. Its surface should be smooth and can be coated with a low-friction material, such as PTFE (Teflon®).

Thus, to mount the web 22, either originally or for replacement, the shaft 18 is dismounted from the pool cleaner 10 (in retrofitting, any used brush is then removed). Then the web 22 is rolled around the shaft 18, the first and second elements 36, 38 are snapped together for a temporary hold and then the locking pin 50 is inserted in the open path 40 to secure the brush during the cleaning operation. The shaft 18 with the new web 22 thereon is then remounted onto the pool cleaner 10. Because the snapping hold of the first and second annular elements 36, 38 is only required for a temporary hold while the pool cleaner is not in operation, this snapping hold need not be as firm as the various tabs and interlocking elements required by the prior art cleaning mats, which relied on such means for securing the brush during the cleaning operation when the cleaning brush assembly 20 is under much greater pushing and pulling stress. Accordingly, the positioning of the first and second annular elements 36, 38 is much more easily achieved, requiring less strength and less precision in alignment.

In order to remove a used web 22 for replacement, the locking pin 50 is withdrawn; the first and second annular elements 36, 38 can then be easily separated to enable the web 22 to be peeled off of the shaft 18. Again, because the snap-fit of the adjacent edge elements of web 22 is not required to be as tight as that in the prior art, the separation of the first and second annular elements 36, 38 is more easily achieved. Moreover, since the mounting ribs 24 are used rather than a flat inner surface, there is less surface area for mold and dirt residues to build up that can cause the old web 22 to stick to the shaft.

While a locking pin has been described as an advantageous and preferred means for providing a positive lock between the ends of the first and second annular elements, it will be understood that elements of different configuration may be used with other locking means to provide the positive lock without departing from the scope and teachings of the present invention.

While particular configurations of the mounting ribs 24 and the cleaning ribs 28 have been illustrated, it will be understood that other configurations that achieve the desired results are possible and within the scope of the present invention. For example, the mounting ribs can be formed by a plurality of spaced-apart elements in the form of cylindrical or tapered shafts, intermittent ribs, or projections of other regular or irregular cross-sections.

While the present invention has been described with reference to the foregoing embodiments, changes and variations may be made therein which fall within the scope of the appended claims.

What is claimed is:

1. A cleaning brush assembly for mounting on a power-driven rotatable shaft of a swimming pool cleaning apparatus for contacting surfaces of the pool to be cleaned, said brush assembly comprising:

a flexible web having first and second opposing edges, said first edge having at least one first element having a first opening therethrough extending in a direction parallel to the first edge, and said second edge having at least one second element having a second opening therethrough extending in a direction parallel to the second edge, said web having a first surface with a plurality of mounting members projecting therefrom and an opposing second surface with a plurality of cleaning members projecting therefrom, and said web being deformable about the rotatable shaft to bring said first and second edges into contact, with said first element being in spaced relation to said second element such that said first opening is aligned with said second opening to form a continuous open path, and to orient said web with said first surface facing toward the shaft and said second surface facing away from the shaft with said cleaning members extending outwardly for contacting the pool surfaces as the shaft is driven; and a locking pin sized to fit within said open path to hold said first and second elements together in a secure, locking fit with said mounting members engaging the shaft for inhibiting relative rotation between the shaft and said web, wherein said mounting members space said web from the shaft and are spaced apart on said web to permit fluid circulation between the shaft and said web.

2. The brush assembly of claim 1, wherein said first and second openings are of the same diameter and said locking pin is sized to fit firmly within said diameter.

3. The brush assembly of claim 1, wherein said mounting members comprise a plurality of mounting ribs.

4. The brush assembly of claim 3, wherein said mounting ribs comprise a plurality of spaced-apart rib portions disposed end-to-end.

5. The brush assembly of claim 4, wherein said rib portions are arranged in plural rows parallel to said first and second edges of said web, each said row comprising a plurality of said spaced-apart rib portions.

6. The brush assembly of claim 1, wherein said cleaning members comprise a plurality of deformable cleaning ribs.

7. The brush assembly of claim 1, wherein said first edge has a first plurality of said first elements and said second edge has a second plurality of said second elements, and wherein said plurality of said first elements fit into spaces between said second plurality of said second elements and said plurality of said second elements fit into spaces between said first plurality of said first elements.

8. The brush assembly of claim 7, wherein a fit between said first plurality of said first elements and said second plurality of said second elements is a snap-fit adapted to hold said first and second edges in contact.

9. The brush assembly of claim 7, wherein said first and second openings of each of said first and second pluralities, respectively, are of the same diameter and said locking pin is sized to fit firmly within said diameter.

10. The brush assembly of claim 7, wherein said first and second elements are integrally molded with the flexible web.

11. A cleaning brush assembly for mounting on a power-driven rotatable shaft of a swimming pool cleaning apparatus for contacting surfaces of the pool to be cleaned, said brush assembly comprising:

a flexible web having first and second opposing edges, said first edge having at least one first element integral with and extending in the direction of the first edge, and said second edge having at least one second element integral with and extending in the direction of the second edge, said web having a first surface with a plurality of mounting members projecting therefrom and an opposing second surface with a plurality of cleaning members projecting therefrom, and said web being deformable about the rotatable shaft to bring said first and second edges into contact, with said first element being in spaced relation to said second element such that said first element is aligned with said second element, and to orient said web with said first surface facing toward the shaft and said second surface facing away from the shaft with said cleaning members extending outwardly for contacting the pool surfaces as the shaft is driven; and a positive locking structure to hold said first and second elements together in a secure, locking fit with said mounting members engaging the shaft for inhibiting relative rotation between the shaft and said web, wherein said mounting members space said web from the shaft and are spaced apart on said web to promote fluid circulation between the shaft and said web.

12. The brush assembly of claim 11, wherein said mounting members comprise a plurality of mounting ribs.

13. The brush assembly of claim 12, wherein said mounting ribs comprise a plurality of spaced-apart rib portions disposed end-to-end.

14. The brush assembly of claim 13, wherein said first and second edges are parallel and said mounting ribs are arranged in plural rows parallel thereto, each said row comprising a plurality of said spaced-apart rib portions.

15. The brush assembly of claim 11, wherein said cleaning members comprise a plurality of deformable cleaning ribs.

16. The brush assembly of claim 11, wherein said first edge has a first plurality of said first elements and said second edge has a second plurality of said second elements, and wherein said plurality of said first elements fit into spaces between said second plurality of said second elements and said plurality of said second elements fit into spaces between said first plurality of said first elements.

17. The brush assembly of claim 16, wherein a fit between said first plurality of said first elements and said second plurality of said second elements is a snap-fit adapted to hold said first and second edges in contact.

18. The brush assembly of claim 17, wherein the snap-fit is between concave and convex adjoining surfaces of said first and second elements.

19. The brush assembly of claim 17, wherein the snap-fit is between detents and corresponding projecting tabs formed in adjoining surfaces of said first and second elements.

* * * * *